US005177989A

United States Patent [19]

Stillwagon

[11] Patent Number: 5,177,989

[45] Date of Patent: Jan. 12, 1993

[54] KEY HOLDER WITH SWIVEL CARTRIDGE

[75] Inventor: Woodrow C. Stillwagon, Fulton County, Ga.

[73] Assignee: Stillwagon Applied Technology Incorporated, Columbus, Ohio

[21] Appl. No.: 724,712

[22] Filed: Jul. 2, 1991

[51] Int. Cl.[5] ..... A44B 15/00

[52] U.S. Cl. ..... 70/456 R

[58] Field of Search ..... 70/456 R–458

[56] References Cited

U.S. PATENT DOCUMENTS

| | | | |
|---|---|---|---|
| D. 153,677 | 5/1949 | Georganta | 70/456 R |
| D. 235,385 | 6/1975 | Smyth | D87/8 |
| D. 271,443 | 11/1983 | MacDonald | D3/61 |
| D. 285,987 | 10/1986 | MacDonald | D3/61 |
| D. 299,480 | 1/1989 | Harari | D3/61 |
| D. 306,799 | 3/1990 | Colan | D3/61 |
| D. 308,601 | 6/1990 | MacDonald | D3/61 |
| D. 310,136 | 8/1990 | MacDonald | D3/61 |
| D. 310,306 | 9/1990 | MacDonald | D3/61 |
| D. 310,447 | 9/1990 | MacDonald | D3/61 |
| D. 310,753 | 9/1990 | Stillwagon et al. | D3/61 |
| D. 317,086 | 5/1991 | Stillwagon et al. | D3/61 |
| D. 318,952 | 8/1991 | Stillwagon et al. | D3/61 |
| 760,410 | 5/1904 | Arnold . | |
| 1,835,793 | 12/1931 | Lurie | 70/456 B |
| 2,129,915 | 9/1938 | Du Pont | 70/456 B X |
| 2,232,333 | 2/1941 | McGehee | 70/456 |
| 2,969,823 | 1/1961 | Sherwood | 70/456 B X |
| 3,186,052 | 6/1965 | Bobrow | 24/201 |
| 3,299,679 | 1/1967 | Anderson | 70/459 |
| 3,587,262 | 6/1971 | Kaye | 70/456 R |
| 3,600,917 | 8/1971 | Krock | 70/459 |
| 3,618,346 | 11/1971 | Humphrey | 70/456 R X |
| 3,777,523 | 12/1973 | Holland | 70/456 R |
| 3,906,763 | 9/1975 | Bochory | 70/456 |
| 4,079,607 | 3/1978 | Spruyt | 70/456 |
| 4,248,071 | 2/1981 | Kussoy | 70/456 R |
| 4,422,316 | 12/1983 | Thomas et al. | 70/456 R |
| 4,524,594 | 6/1985 | Bascou | 70/456 R |
| 4,765,459 | 8/1988 | Edwards | 206/38.1 |
| 4,776,191 | 10/1988 | MacDonald | 70/459 |
| 4,821,543 | 4/1989 | Scungio | 70/456 |
| 4,951,489 | 8/1990 | Proch | 70/456 R |

FOREIGN PATENT DOCUMENTS

| | | | |
|---|---|---|---|
| 0088699 | 9/1983 | European Pat. Off. | 70/456 R |
| 0117204 | 8/1984 | European Pat. Off. | 70/456 R |
| 625914 | 9/1961 | Italy | 70/456 R |

OTHER PUBLICATIONS

Sketch of Spring/Hook Key Holder (cross-sectional).
Photographs of Transmitter Key Holder (Photocopies).
Photograph of Top View of Disconnected Ball/-Groove Key Holder.
Photograph of End View of One Member of Ball/-Groove Key Holder.
Photograph of Top View of Disconnected Compression Ring Key Holder.
Photograph of End View of One Member of Compression Ring Key Holder.

*Primary Examiner*—Renne S. Luebke
*Assistant Examiner*—Suzanne L. Dino
*Attorney, Agent, or Firm*—Louis T. Isaf

[57] ABSTRACT

Key holder includes, in its most preferred embodiment, front and back covers with interlocking hinge appendages defining a transverse passageway inside which is located a swivel cartridge functioning both as a hinge pin and as a swivelling key attachment device. Swivel cartridge includes a casing, a swivel member located at least partially within the casing so as to be capable of rotation with respect to the casing and extending out through a first end of the casing to define a ring passageway through which a key ring is attachable, a hook member contacting the swivel member within the casing and extending out through a second end of the casing, and a spring located within the casing for urging the hook member toward the first end of the casing, thereby maintaining continuous contact between the hook member and the swivel member. By depressing the swivel member, thereby compressing the spring, the hook member is urged out from the casing to provide access to the end of the hook member around which a key ring is attachable.

22 Claims, 6 Drawing Sheets

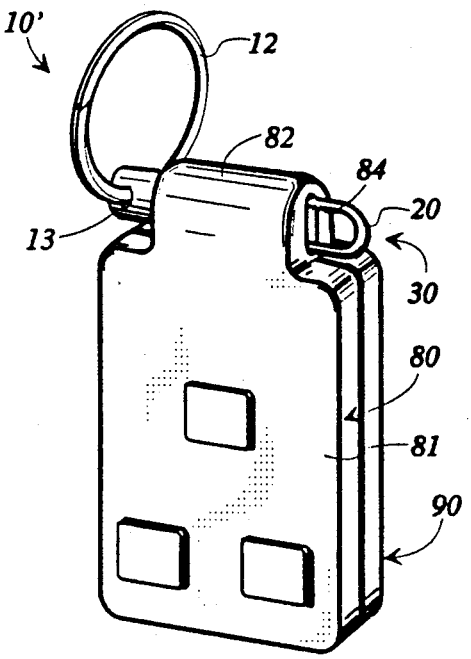
FIG 26
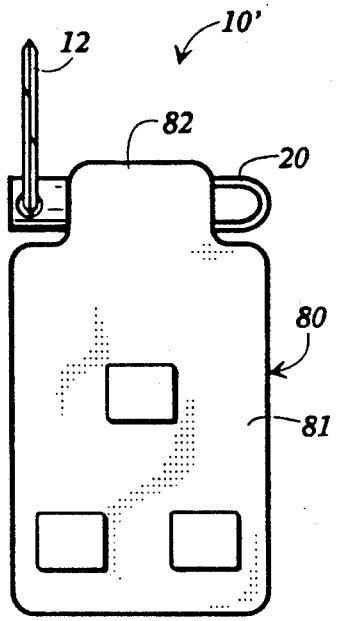
FIG 27
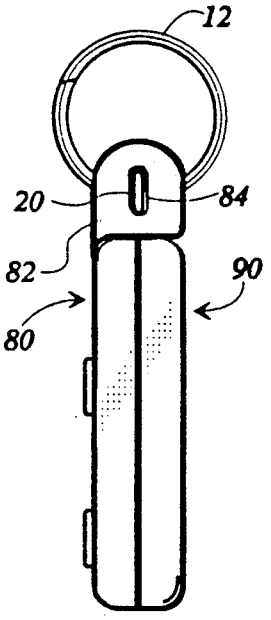
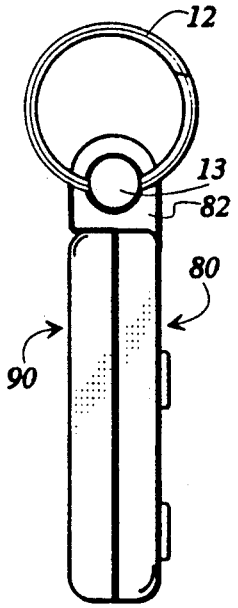
FIG 28 FIG 29
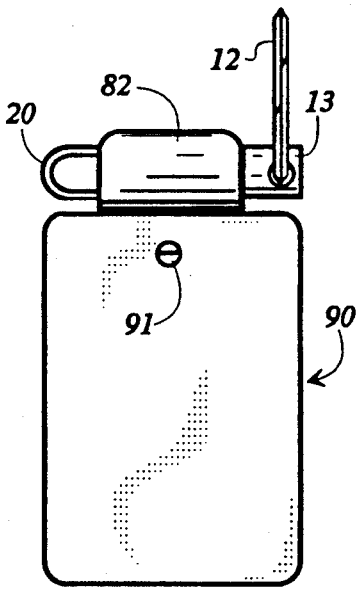
FIG 30
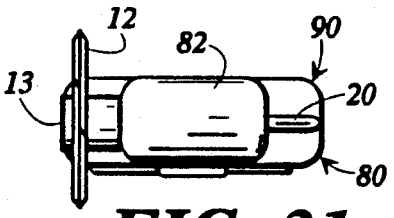
FIG 31
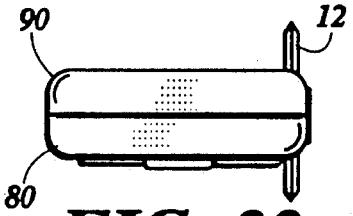
FIG 32

KEY HOLDER WITH SWIVEL CARTRIDGE

BACKGROUND OF THE INVENTION

The present invention relates generally to the field of key holders, and, in its most preferred embodiment, to the field of key holders which include swivel cartridges and are designed to perform other functions in addition to holding keys.

Many different types of key holders are in use today, from simple circular key rings to deluxe assemblies designed to perform other functions in addition to holding keys. Examples of these deluxe assemblies include key holders with main assemblies which function as whistles, pen lights, watches, tear gas holders, floatation devices, and containers for holding such things as important documentation, medication, or perfume. Additionally, with the advent of the use of radio frequency (RF) receivers in automobiles to provide access to car doors and car trunks, key holders which function as RF transmitters have also been produced.

One problem associated with many of these key holders relates to the structures through which typical key rings are attached to the main assemblies of the key holders. One typical structure includes a wedge-shaped tab extending out from the main assembly and having a small circular passageway for receipt of a typical circular key ring. During storage in a person's pocket or purse, various forces often attempt to rotate the keys and the main assembly with respect to each other. In some circumstances, this attempted rotation results in breakage of the wedge-shaped tab.

Additionally, because the tab is often located near a connection between elements of the main assembly, rotational stress on the tab tends to disconnect these elements. While this is clearly an undesirable consequence, the degree of the problem rises when sensitive electronics which require relatively tight seals are involved, as is the case with RF transmitters. Furthermore, if the key holder is stored in a person's pocket, the key holder may become uncomfortable due to its inability to allow the key ring to rotate. Also, in many circumstances, manual, rather than automatic, assembly of the key ring onto the tab is required, resulting in larger costs and a higher degree of worker related injuries.

Other types of key holders are designed to include two key rings which can be selectively separated. This feature allows one to logically divide keys into separate groups, such as keys for the home, on one ring, and keys for the car or office, on the second ring. The ability to separate home or office keys from car keys can provide an extra measure of safety when leaving a car for service, or with a valet parking attendant, etc. One problem affecting the usefulness of many of these types of key holders is related to the difficulty involved in separating the rings. The separation methods employed by many of these key holders are both difficult to remember and difficult to perform. There is, therefore, a need to provide a key holder which solves these and other related, as well as unrelated, problems.

SUMMARY OF THE INVENTION

Briefly described, the present invention, in its most preferred embodiment, comprises a key holder which includes a front cover with two appendages which are separated by a recess and through which passageways coaxially extend, a back cover connected to the front cover so that an appendage extending from the back cover is located within the recess between the appendages of the front cover and so that a passageway extending through the appendage of the back cover is coaxial with the passageways in the two appendages of the front cover, and a swivel cartridge extending, at least partially, through the appendages of both the front and back covers.

The swivel cartridge includes a outer casing which is wedged into the appendage passageways, thereby functioning as a hinge pin in cooperation with the appendages, a swivel member located at least partially within the casing and extending through a first end of the casing, the swivel member having a ring passageway through which a key ring is attachable and being rotatable with respect to the key holder, a hook member contacting the swivel member within the casing and extending through a second end of the casing, and a spring located within the casing for urging the hook member toward the first end of the casing, thereby maintaining continuous contact between the hook member and the swivel member. When a user depresses the swivel member, thereby compressing the spring, the hook member is extended out from the casing to provide access to the end of the hook member around which a key ring is attachable. In the most preferred embodiment of the present invention, an RF transmitter is enclosed within the key holder, and control buttons extend through the front cover.

Although the preferred embodiment of the present invention includes a swivel cartridge which, among other things, functions as a hinge pin, alternate embodiments of the present invention include a unitary housing with a long appendage for containing the entire casing, and a small cover having no appendages for connection to the back of the unitary housing. In those alternate embodiments, the swivel cartridge does not function as a hinge pin. Other alternate embodiments of the present invention include key holders with swivel cartridges which perform alternate functions, such as providing storage enclosures. Also, although the preferred embodiment of the present invention includes an appendage which does not provide for independent rotation of the hook, alternate embodiments include appendages which allow independent rotation of both the swivel member and the hook member with respect to the key holder.

It is therefore an object of the present invention to provide a key holder which includes an RF transmitter and a device for receiving a key ring which allows for complete rotation of the key ring.

Another object of the present invention is to provide a key holder which provides for easy separation of two distinct sets of keys.

Yet another object of the present invention is to provide a key holder which includes a swivel member rotatably connected to a hook member.

Yet another object of the present invention is to provide a key holder which includes a swivel cartridge which includes a casing, a swivel member rotatably connected, and partially located, within the casing, a hook member rotatably connected, and partially located, within the casing, and a spring located within the casing for urging the hook member toward contact with the swivel member.

Yet another object of the present invention is to provide a key holder with front and back covers which enclose an RF transmitter and a swivel cartridge connected to the covers which functions as a hinge pin for the two covers and a device for rotatably connecting a key ring to the two covers.

Still another object of the present invention is to provide a key holder which includes front and back covers, both having appendages with passageways which are coaxially aligned and in which a swivel cartridge is located to provide a device for the rotatable attachment of two key rings and for functioning as a hinge pin in cooperation with the appendages.

Still another object of the present invention is to provide a swivel cartridge with a knurled casing and a spring loaded hook for functioning both as an attachment device and as a hinge pin between two bodies.

Other objects, features and advantages of the present invention will become apparent upon reading and understanding this specification, taken in conjunction with the accompanying drawings.

BRIEF DESCRIPTION OF THE DRAWINGS

FIG. 26 is a perspective view of the Key Holder with Swivel Cartridge in accordance with an alternate embodiment of the present invention.

FIG. 27 is a front view of the alternate embodiment of FIG. 26.

FIG. 28 is a right side view of the alternate embodiment of FIG. 26.

FIG. 29 is a left side view of the alternate embodiment of FIG. 26.

FIG. 30 is a rear view of the alternate embodiment of FIG. 26.

FIG. 31 is a top view of the alternate embodiment of FIG. 26.

FIG. 32 is a bottom view of the alternate embodiment of FIG. 26.

DETAILED DESCRIPTION OF THE PREFERRED EMBODIMENT

Figure 1:
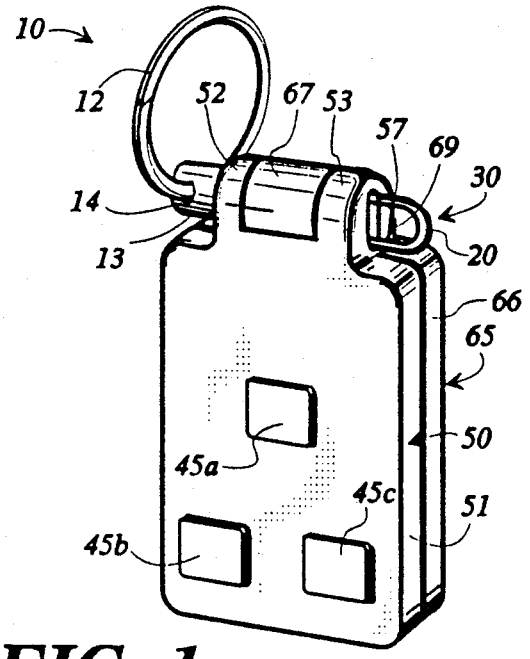
FIG. 1 is a perspective view of the Key Holder with Swivel Cartridge in accordance with the preferred embodiment of the present invention.
Figure 2:
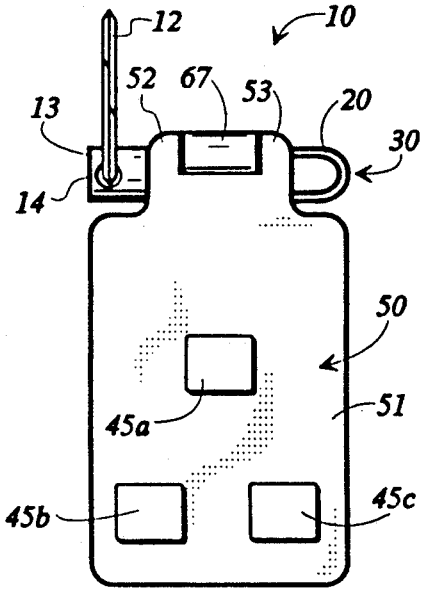
FIG. 2 is a front view of the preferred embodiment of FIG. 1.
Figure 3:
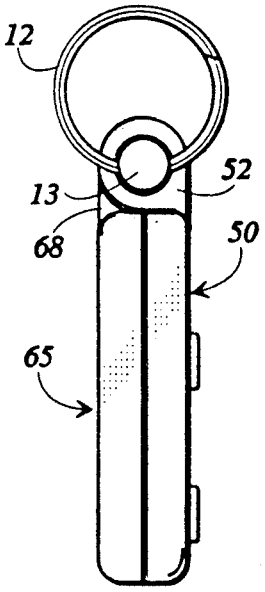
FIG. 3 is a left side view of the preferred embodiment of FIG. 1.
Figure 4:
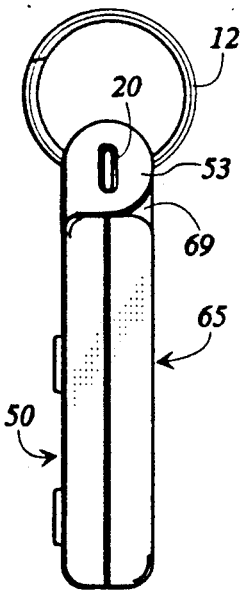
FIG. 4 is a right side view of the preferred embodiment of FIG. 1.
Figure 5:
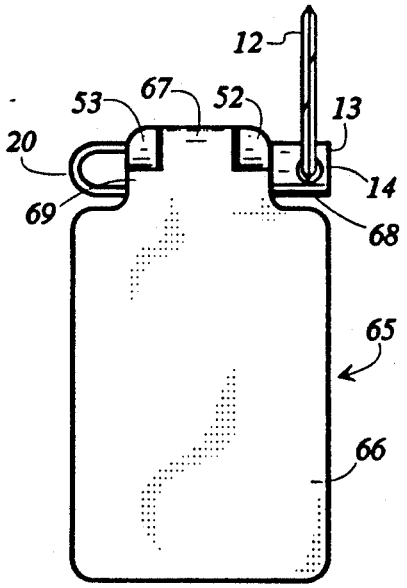
FIG. 5 is a rear view of the preferred embodiment of FIG. 1.
Figure 6:
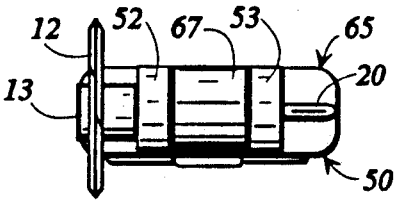
FIG. 6 is a top view of the preferred embodiment of FIG. 1.
Figure 7:
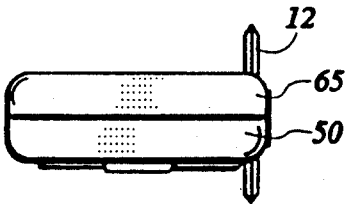
FIG. 7 is a bottom view of the preferred embodiment of FIG. 1.

Referring now in greater detail to the drawings, in which like numerals represent like components throughout the several views, the preferred embodiment of the Key Holder with Swivel Cartridge 10 is shown in FIGS. 1–7. FIG. 1 is a perspective view of the Key Holder with Swivel Cartridge 10 in accordance with the preferred embodiment of the present invention. FIGS. 2–7 are front, left side, right side, rear, top, and bottom views, respectively, of the preferred embodiment of FIG. 1. Referring to FIGS. 1–7, a front cover 50 is shown including a front cover body 51, through which three RF transmitter control buttons 45*a*, 45*b*, 45*c* protrude. The front cover 50 also includes a left appendage 52 and a right appendage 53 attached to the top of the front cover body 51. Releasably connected to the front cover 50 is a back cover 65 which includes a back cover body 66 and a middle appendage 67 positioned between the left appendage 52 and the right appendage 53. Also extending upward from the back cover body 66 are a left appendage wedge 68 and a right appendage wedge 69. Extending through the appendages 52, 53, 67 is a swivel cartridge 30. Included as part of the swivel cartridge 30 and protruding outward from the left appendage 52 is a swivel 13 which includes a loop passage 14 through which a key loop 12 is threaded. Protruding outward from the right appendage 53 is a hook 20. In the preferred embodiment, the swivel 13 is, but the hook 20 is not, free to rotate with respect to the covers 50, 65.

Figure 8:
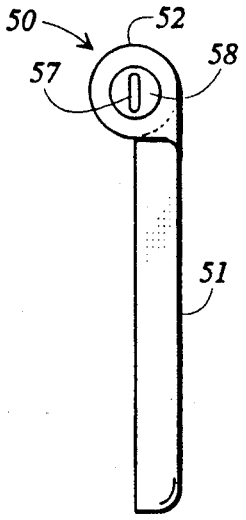
FIG. 8 is an isolated left side view of the front cover of FIG. 1.
Figure 9:
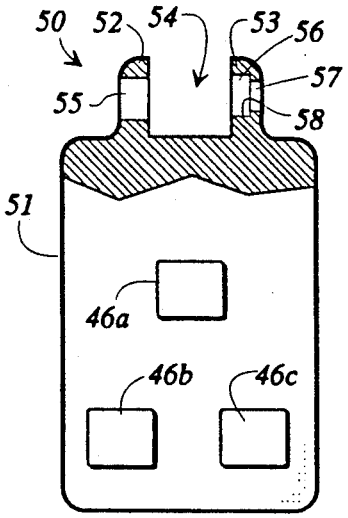
FIG. 9 is an isolated front view of the front cover of FIG. 1 with parts cut away for clarity.
Figure 10:
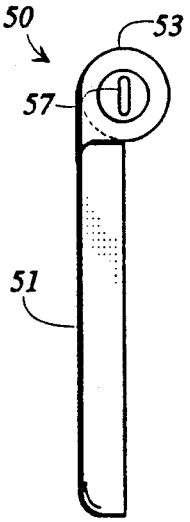
FIG. 10 is an isolated right side view of the front cover of FIG. 1.
Figure 10A:
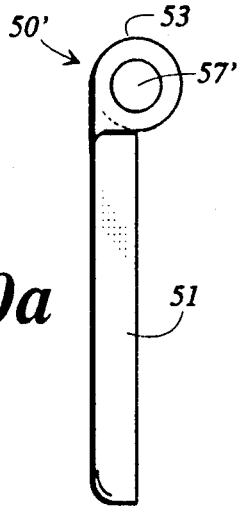
FIG. 10*a* is an isolated right side view of the front cover in accordance with an alternate embodiment.

FIGS. 8–10 are isolated left side, isolated front cutaway, and isolated right side views, respectively, of the front cover 50. As described above, the front cover 50 includes the front cover body 51 and the left and right appendages 52. 53. Three RF transmitter control button holes 46*a*, 46*b*, 46*c* extend through the front cover body 51. The left and right appendages 52, 53 are separated by an appendage recess 54. A left casing passage 55 extends through the left appendage 52, and a right casing passage 56 extends partially through the right appendage 53. A hook passage 57 with a relatively rectangular cross-section connects to the right casing passage 56, forming a cover shoulder 58. The passages 55, 56, 57 are, in the preferred embodiment, coaxial with respect to each other. FIG. 10*a* is an isolated right side view similar to FIG. 10 of the front cover 50' shown in accordance with an alternate embodiment, including an alternately shaped (i.e. circular) hook passage 57'.

Figure 11:
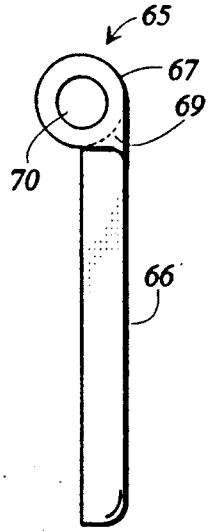
FIG. 11 is an isolated right side view of the rear cover of FIG. 1.
Figure 12:
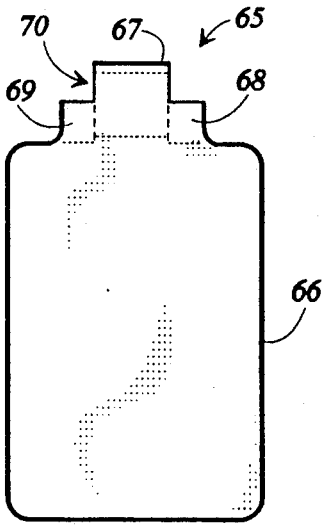
FIG. 12 is an isolated rear view of the rear cover of FIG. 1 shown with dotted lines for clarity.
Figure 13:
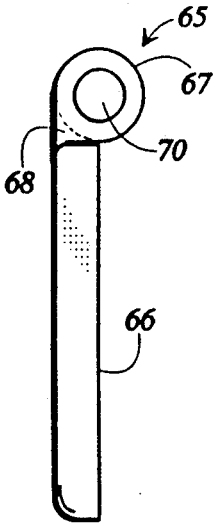
FIG. 13 is an isolated left side view of the rear cover of FIG. 1.

FIGS. 11–13 are isolated right side, isolated rear, and isolated left side views of the back cover 65. The back cover includes the back cover body 66, the middle appendage 67, and the left and right appendage wedges 68, 69. In addition, a middle casing passage 70 extends through the middle appendage 67.

Figure 14:
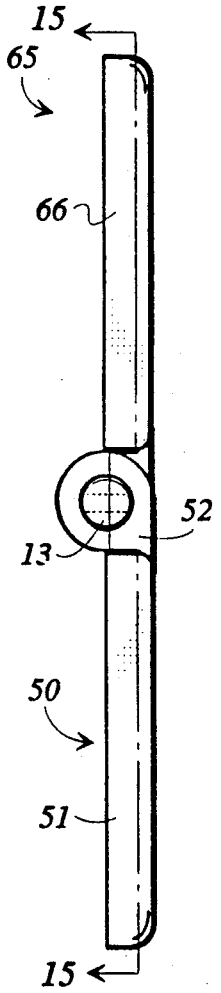
FIG. 14 is a left side view of the front cover, rear cover, and swivel cartridge of the preferred embodiment of FIG. 1 shown connected in an open orientation.
Figure 15:
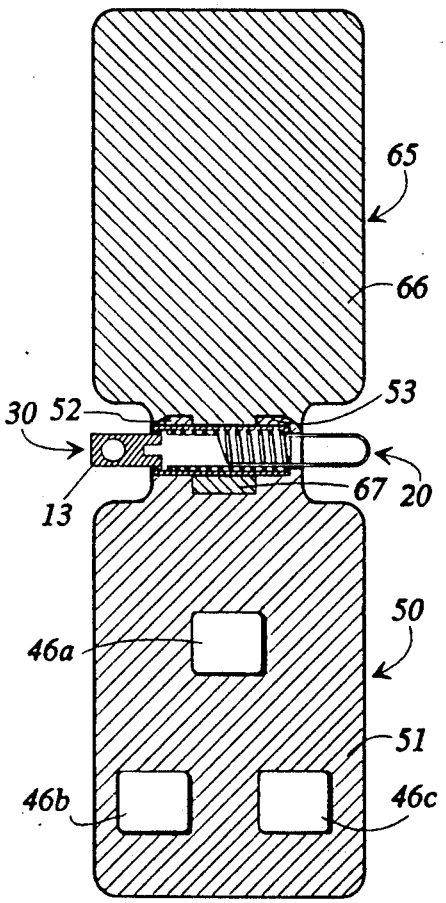
FIG. 15 is a front cross-sectional view of the arrangement shown in FIG. 14.
Figure 16:
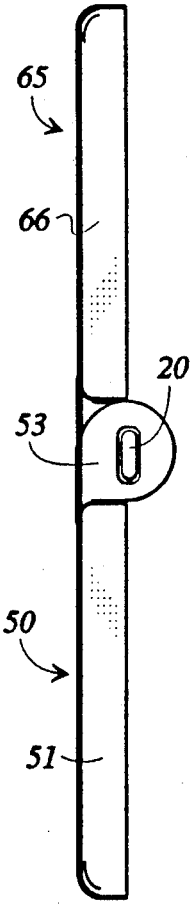
FIG. 16 is a right side view of the arrangement of FIG. 14.
Figure 17:
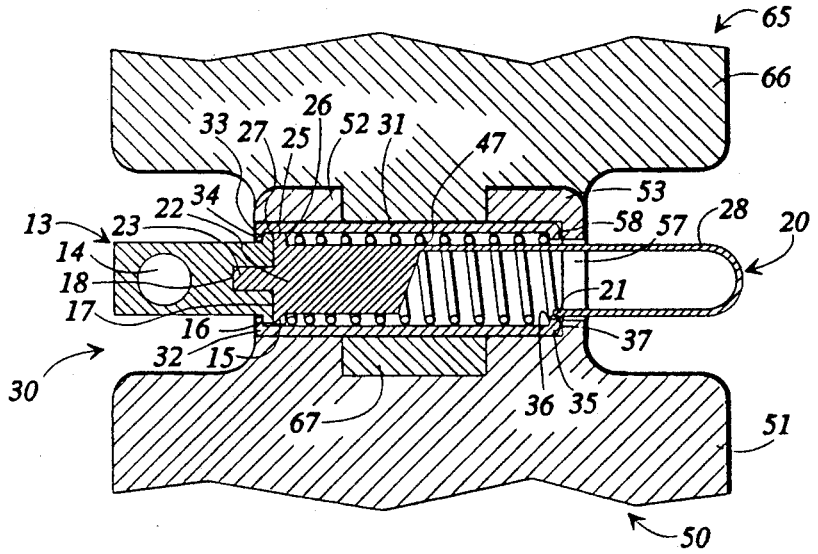
FIG. 17 is a front cross-sectional view similar to FIG. 15 showing only partial front and rear covers and showing the hook member in an alternate orientation.

While FIGS. 1–7 show the preferred embodiment of the present invention in a closed orientation, FIGS. 14–16 are left side, front cross-sectional, and right side views, respectively, of the front cover 50, the rear cover 65, and the swivel cartridge 30 of the preferred embodiment of the present invention shown in an open orientation. FIG. 17 is an enlarged front cross-sectional view similar to FIG. 15 showing only portions of the front and rear covers 50, 65 and the hook 20. (Note, the hook 20 of FIG. 17 is seen oriented 180 degrees about the cartridge axis from that of FIG. 15) The swivel cartridge 30 extends through the left appendage 52, the middle appendage 67, and the right appendage 63. Included within the swivel cartridge 30 are the swivel 13, the hook 20, a cartridge casing 31, and a spring 47.

Figure 18:
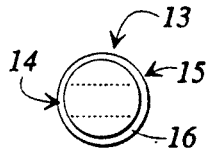
FIG. 18 is an isolated left end view of the swivel member of FIG. 17, showing the loop passage in dotted lines.
Figure 19:
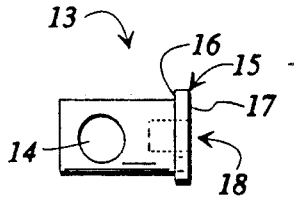
FIG. 19 is an isolated side view of the swivel member of FIG. 17, showing the swivel recess in dotted lines.
Figure 20:
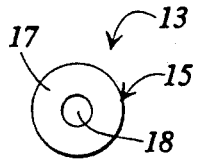
FIG. 20 is an isolated right end view of the swivel member of FIG. 17.

FIGS. 18–20 are isolated left end, isolated side, and isolated right end views, respectively, of the swivel 13. The swivel 13 includes the loop passage 14 and a swivel shoulder 15 having a swivel shoulder face 17 and a swivel shoulder back 16. Defined within the right end of the swivel 13 is a swivel recess 18.

Figure 21:
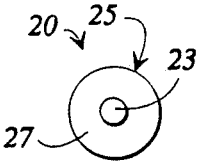
FIG. 21 is an isolated left end view of the hook member of FIG. 17.
Figure 22:
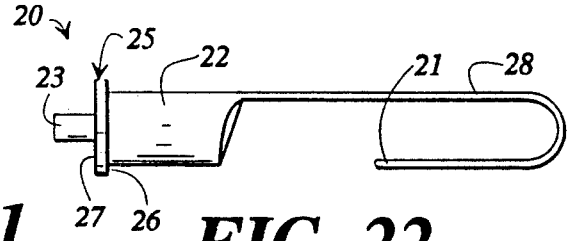
FIG. 22 is an isolated side view of the hook member of FIG. 17.
Figure 23:
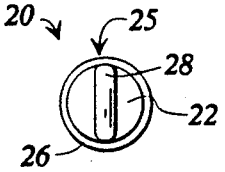
FIG. 23 is an isolated right end view of the hook member of FIG. 17.

FIGS. 21–23 are isolated left end, isolated side, and isolated right end views, respectively, of the hook 20. The hook 20 includes a hook end 21 at the end of a hook extension 28 which is connected to a cylindrical hook base 22. A hook shoulder 25 is connected to the hook base 22 and includes a hook shoulder back 25 and a hook shoulder face 27. Connected to the hook shoulder 25 is a hook pin 23.

Figure 24:
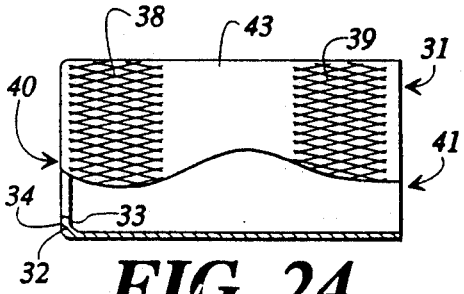
FIG. 24 is an isolated side view of the cartridge casing of FIG. 17, shown with parts cut away for clarity and shown un-crimped.
Figure 25:
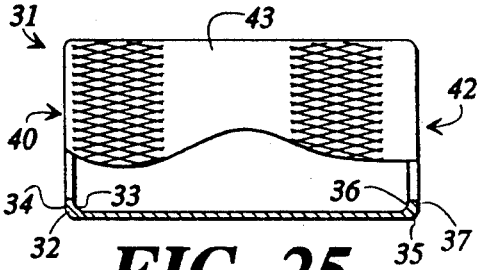
FIG. 25 is an isolated side view of the crimped cartridge casing of FIG. 17, shown with parts cut away for clarity.

FIGS. 24 and 25 are isolated side cut-away views of un-crimped, and crimped, respectively, cartridge casings 31. In both FIGS. 24 and 25, the cartridge casing 31 is seen as a generally cylindrical body. The crimped/uncrimped reference in this context refers to the condition of the right end (in the FIGS.) of the generally cylindrical cartridge casing 31. The cartridge casing 31 includes a formed opening 40 which is bordered by a casing formed shoulder 32 including a formed shoulder face 33 and a formed shoulder back 34. A left casing knurling 38 extends around the left exterior of the cartridge casing 31, and a right casing knurling 39 extends around the right exterior of the cartridge casing 31. Between the knurlings 38, 39, a casing smooth section 43 extends around the exterior of the cartridge casing 31. After a pre-crimped opening 41 is crimped during assembly, a crimped opening 42 results and is bordered by a casing crimped shoulder 35 including a crimped shoulder face 36 and a crimped shoulder back 37.

During assembly, with respect to FIGS. 17–25, the swivel 13 is first inserted, left end first, into the pre-crimped opening 41 of the cartridge casing 31 until the swivel shoulder back 16 contacts the formed shoulder face 33 which prevents the swivel 13 from exiting the formed opening 40. The hook 20 is then inserted, left end first, into the pre-crimped opening 41 of the cartridge casing 31 until the hook pin 23 enters the swivel recess 18 and the hook shoulder face 27 contacts the swivel shoulder face 17. The spring 47 is then placed around hook extension 28 and slid down over the hook base 22. The spring 47 is then compressed until the cartridge casing 31 is crimped to form the crimped opening 42. The construction of the swivel cartridge 30 is then complete. The key loop 12 is then mechanically attached to swivel 13 through the loop passage 14.

The middle appendage 67 of the back cover 65 is then placed in appendage recess 54 (FIG. 9) of the front cover 50 between left and right appendages 52, 53 as shown in FIG. 17. The swivel cartridge 30 is then inserted, hook 20 end first, through the appendages 52, 67, 53, respectively, so that the hook extension 28 protrudes through the hook passage 57 and the crimped shoulder back 37 contacts the cover shoulder 58. The left and right casing knurlings 38, 39 impress into the left and right appendages 52, 53 to rigidly connect the swivel cartridge to the front cover 50, while the middle appendage 67 of the back cover 65 is free to rotate around the casing smooth section 43. The ability to rotate is also due, at least in part, to the rounded portions of the appendages 52, 53, 67. An RF transmitter (not shown), complete with the RF transmitter control buttons 45*a*, 45*b*, 45*c*, is then positioned between the front and back covers 50, 65, which are then fastened together. In the preferred embodiment, this fastening is accomplished through common ridges and grooves (not shown) which provide for a snap connection. In other embodiments, adhesives, screws, and latching devices are utilized.

During operation of the preferred embodiment of the present invention, and with reference to FIGS. 1, 17, and 25, a user simply pushes one of the RF transmitter control buttons 45*a*, 45*b*, 45*c* while in the vicinity of the user's automobile to lock or unlock a door or trunk, in accordance with various methods currently known in the industry. In addition, the user places keys and/or other key loop attachments onto the key loop 12 in the usual well-known manner. Because the swivel 13 is free to rotate within the cartridge casing 31, a means for enabling the complete rotation of the attachments with respect to the covers 50, 65 is provided by the present invention. Furthermore, the design and orientation of the appendages 52, 53, 67, aid in preventing the covers 50, 65 from separating due to forces on the attachments connected to the key loop 12.

The hook 20 is also designed to receive attachments such as keys or key loops. To access the hook 20, the user depresses the swivel 13 into the cartridge casing 31. As force is exerted on swivel 13, the swivel shoulder face 17 exerts a similarly directed force onto the hook shoulder face 27, and a similarly directed force is also directed onto the hook pin 23. Because the spring 47 is positioned between the hook shoulder back 26 and the crimped shoulder face 36, the spring 47 is compressed as the hook 20 moves in response to the depression force on the swivel 13. As the hook 20 is moved toward the right appendage 53, the hook extension 28 is moved through the hook passage 57 until the hook end 21 is accessible outside the hook passage 57. The user then passes the desired attachments around the hook accessible hook end 21 and onto the hook extension 28. Conversely, the user removes attachments intended to be separated from the key holder 10.

In the preferred embodiment, because of the relatively large size of the covers 50, 65, and because of the spatial orientation of the swivel 13 with respect to the covers 50, 65, a user may easily grasp the covers 50, 65 with one hand and depress the swivel 13 with the user's thumb. A means for providing easy separation of at least two distinct sets of key is therefore provided. Upon release of the swivel 13, the spring 47 returns the assembly to its original orientation held before the swivel 13 was depressed.

The combination of the swivel recess 18 and the hook pin 23 provides a basis of support for the swivel 13. This combination tends to resists tilting and/or bending of the swivel 13 caused by various radial forces received through the key loop 12; these harmful movements of the swivel 13, if un-resisted, could undesirably urge the hook 20 toward the crimped opening 42, The relatively rectangular shape of the hook passage 57 in the preferred embodiment provides a basis of rotational orientation for the hook extension 28. Because of the shape of the hook passage 57, the hook end 21 will continue to emerge from the hook passage 57 in the same orientation, providing consistency and convenience for the user. The alternate embodiment shown in FIG. 10*a* includes a circular shaped hook passage 57' which provides for independent rotation of both the swivel 13 and the hook 20.

FIG. 26 is a perspective view of the Key Holder with Swivel Cartridge 10' in accordance with an alternate embodiment of the present invention. FIGS. 27–32 are front, right side, left side, rear, top, and bottom views, respectively, of the alternate embodiment of FIG. 26. A unitary housing 80 is shown including a unitary housing body 81, through which three RF transmitter control buttons 45*a*, 45*b*, 45*c* protrude. The unitary housing 80 also includes a housing appendage 82 attached to the top of the unitary housing body 81. Releasably connected to the unitary housing 80 through a cover screw 91 is a rear housing cover 90 which does not include any appendages. In this alternate embodiment, a similar swivel cartridge 30 is used. However, alternate knurling patterns for swivel cartridge 30, including a completely knurled exterior, are utilized in other embodiments.

Figure 33:
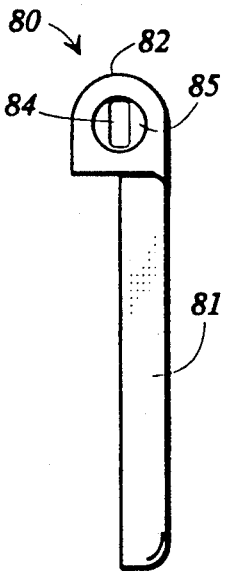
FIG. 33 is an isolated left side view of the unitary housing of FIG. 26.
Figure 34:
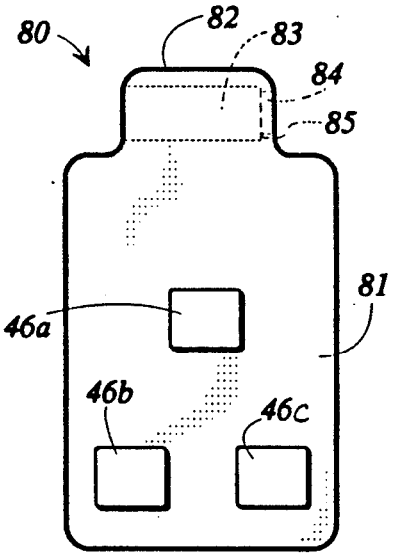
FIG. 34 is an isolated front view of the unitary housing of FIG. 26, showing the unitary casing and hook passages in dotted lines.
Figure 35:
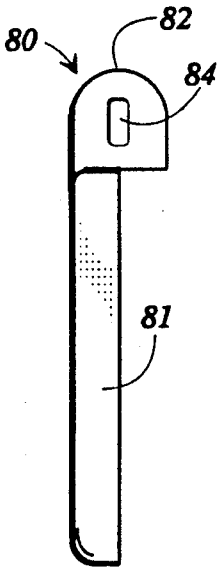
FIG. 35 is an isolated right side view of the unitary housing of FIG. 26.

With reference also to FIGS. 33–35, FIGS. 33–35 are isolated left side, isolated front, and isolated right side views, respectively, of the unitary housing 80. In this embodiment, only one appendage exists, the housing appendage 82. The swivel cartridge 30 is inserted, hook 20 end first, into the left side of a unitary casing passage 83 so that the hook 20 protrudes through a relatively rectangularly shaped unitary hook passage 84 and the swivel cartridge 30 contacts a unitary housing shoulder 85. In still other alternate embodiments of the present invention, the unitary hook passage 84 has a circular shape to provide for independent rotation of both the swivel 13 and the hook 20.

In the alternate embodiment of the present invention represented by FIGS. 26–35, the function of the swivel cartridge 30 is similar to that in the preferred embodiment with the exception of its hinge pin function in the preferred embodiment. In this alternate embodiment, the rear housing cover 90 is connected to the unitary housing body 81 without any interaction with the swivel cartridge 30. Thus, the functioning of the swivel cartridge 30 is completely independent from the connection between the unitary housing 80 and the rear housing cover 90. The likelihood of any affect on the integrity of the connection between the unitary housing body 31 and the rear housing cover 90 from forces imposed upon the swivel cartridge 30 is greatly reduced.

Other alternate embodiments of the present invention include variously shaped key holder housings and covers which perform functions completely unrelated to RF transmitters. Additionally, another embodiment includes use of the swivel cartridge in isolation as a complete key holder. Furthermore, the swivel cartridge is used in other embodiments to function as a hinge pin between two bodies and to attach thereto items having nothing to do with keys.

While the embodiments of the present invention which have been disclosed herein are the preferred forms, other embodiments of the method and apparatus of the present invention will suggest themselves to persons skilled in the art in view of this disclosure. Therefore, it will be understood that variations and modifications can be effected within the spirit and scope of the invention and that the scope of the present invention should only be limited by the claims below. It is also understood that the relative dimensions and relationships shown on the drawings are given as the preferred relative dimensions and relationships, but the scope of the invention is not to be limited thereby.

I claim:

1. A key holder for holding keys and housing an RF transmitter, said key holder comprising:

a front cover including, at least, a left appendage and a right appendage separated by a recess, said left appendage defining a left passageway, said right appendage defining a right passageway, the right passageway being coaxial with the left passageway;

a back cover including, at least, a middle appendage defining a middle passageway, said back cover connected with said front cover so that said middle appendage is located within the recess between said left appendage and said right appendage and the middle passageway is coaxial with the left passageway and the right passageway; and a swivel cartridge located within, at least partially, the left passageway, the middle passageway, and the right passageway and including, at least, a swivel member and a hook member.

2. An apparatus for holding keys, said apparatus comprising:

a front cover including, at least, a front appendage defining a front transverse passageway;

a back cover including, at least, a back appendage defining a back transverse passageway; and a hinge pin means located at least partially within said front and back passageways for functioning as a hinge pin with respect to said front and back covers, said hinge pin means including, at least, a key attachment means located at least partially outside said front and back transverse passageways for receiving keys outside said front and back transverse passageways.

3. Apparatus of claim 2, wherein said hinge pin means includes, at least, a cartridge assembly including, at least, a casing, a swivel member located partially within said casing, and a hook member located at least partially within said casing and contacting said swivel member.

4. Apparatus of claim 2, wherein said key attachment means includes, at least, a swivel member being capable of rotation relative to said front and back cover.

5. Apparatus of claim 4, wherein said key attachment means further includes, at least, a key ring connected to said swivel member.

6. Apparatus of claim 2, wherein said key attachment means includes, at least, a retractable hook member.

7. Apparatus of claim 2, wherein said hinge pin means further includes, at least, a hollow cylindrical casing defining a first end and a second end, and wherein said key attachment means includes, at least, a swivel member located at least partially within said casing so as to be capable of rotation with respect to said casing and extending out through said first end of said casing.

8. Apparatus of claim 7, wherein said key attachment means further includes, at least, a key ring connected to said swivel member.

9. Apparatus of claim 7, wherein said key attachment means further includes, at least, a retractable hook member contacting said swivel member inside said casing and extending out through said second end of said casing.

10. Apparatus of claim 9, wherein said hook member includes, at least, a knob protruding toward said first end of said casing, and wherein said swivel member further includes, at least, a recess for receiving said knob of said hook member.

11. Apparatus of claim 9, wherein said hinge pin means further includes a biasing means for biasing said hook member toward said first end of said casing to abut against said swivel member.

12. Apparatus of claim 9, wherein said front cover further includes orientation means for orienting said hook member.

13. Apparatus of claim 2, further including an RF transmitter located between said front cover and said back cover.

14. An apparatus for holding keys, said apparatus comprising:

a front cover including, at least, a front appendage defining a front transverse passageway;

a back cover including, at least, a back appendage defining a back transverse passageway; and a hinge pin means located at least partially within said front and back passageways for functioning as a hinge pin with respect to said front and back covers, said hinge pin means including, at least, a hollow cylindrical casing defining a first end and a second end, a key attachment means located at least partially outside said front and back transverse passageways for receiving keys outside said front and back transverse passageways, said key attachment means including, at least, a swivel member located at least partially within said casing so as to be capable of rotation with respect to said casing and extending out through said first end of said casing, said swivel member including, at least, a recess accessible from inside said casing, a key ring connected to said swivel member, and a retractable hook member contacting said swivel member inside said casing and extending out through said second end of said casing, said hook member including, at least, a knob protruding toward said first end of said casing into said recess of said swivel member, and a biasing means for biasing said hook member toward said first end of said casing to abut against said swivel member.

15. An apparatus for attachment to external objects, including keys, said apparatus comprising:

a first body member including, at least, an appendage defining a transverse passageway; and a swivel cartridge assembly located at least partially within said transverse passageway and including, at least, a hollow cylindrical casing defining a first end and a second end, a first attachment means for attaching an external object to said apparatus, said first attachment means being located at least partially within said casing and extending out through said first end of said casing, and a second attachment means for attaching an external object to said apparatus, said second attachment means being located at least partially within said casing and extending out through said second end of said casing.

16. Apparatus of claim 15, wherein said first body member further includes, at least, a containment area.

17. Apparatus of claim 15, further including a second body member connected to said first body member to define a containment area.

18. Apparatus of claim 17, wherein said second body member includes, at least, an appendage defining a transverse passageway coaxially aligned with said transverse passageway of said first body member and occupied, at least partially, by said swivel cartridge assembly.

19. Apparatus of claim 15, wherein said first attachment means abuts said second attachment means within said casing.

20. Apparatus of claim 15, wherein said first attachment means and said second attachment means are independently capable of rotating relative to said casing.

21. Apparatus of claim 15, wherein said swivel cartridge assembly further includes, at least, a biasing means for biasing said second attachment means against said first attachment means.

22. Apparatus of claim 15, wherein said first attachment means includes a ring means for receiving keys, and wherein said second attachment means includes a retractable hook means for receiving keys.

* * * * *